United States Patent [19]

Mascioni et al.

[11] 4,242,957

[45] Jan. 6, 1981

[54] PROCESS AND APPARATUS FOR THE PRINTING OF SPONGE-CLOTHS AND THE LIKE

[75] Inventors: Umberto Mascioni, Azzio; Adolfo Giani, Bergamo; Mario Panseri, Ranica, all of Italy

[73] Assignee: Reggiani S.p.A., Bergamo, Italy

[21] Appl. No.: 925,198

[22] Filed: Jul. 17, 1978

[30] Foreign Application Priority Data

Jul. 19, 1977 [IT] Italy ..... 25881 A/77

[51] Int. Cl.[3] ..... B41L 13/02; B41N 1/24

[52] U.S. Cl. ..... 101/126

[58] Field of Search ..... 101/114, 115, 116, 117, 101/121-123, 126, 129, 196, 211; 226/8, 27, 32, 33, 34, 45

[56] References Cited

U.S. PATENT DOCUMENTS

| | | | |
|---|---|---|---|
| 3,066,602 | 12/1962 | Ichinose | 101/115 |
| 3,460,470 | 8/1969 | Green et al. | 101/129 X |
| 3,467,004 | 9/1969 | Best et al. | 101/129 X |
| 3,650,208 | 3/1972 | Lambert | 101/114 X |
| 3,735,699 | 5/1973 | Koelschbach | 101/115 |
| 3,812,779 | 5/1974 | Cobb | 101/115 |
| 3,848,528 | 11/1974 | Seedorf | 101/115 |
| 3,945,317 | 3/1976 | Brasa | 101/115 |
| 3,974,766 | 8/1976 | Zimmer | 101/129 |
| 4,079,674 | 3/1978 | Ichinose | 101/115 X |

FOREIGN PATENT DOCUMENTS

| | | | |
|---|---|---|---|
| 2001780 | 1/1970 | Fed. Rep. of Germany | 101/115 |
| 2642956 | 4/1977 | Fed. Rep. of Germany | 101/115 |
| 2644479 | 4/1977 | Fed. Rep. of Germany | 101/115 |
| 2656471 | 6/1977 | Fed. Rep. of Germany | 101/129 |
| 1434875 | 5/1976 | United Kingdom | 101/115 |
| 1442926 | 7/1976 | United Kingdom | 101/116 |

*Primary Examiner*—E. H. Eickholt

*Attorney, Agent, or Firm*—Stevens, Davis, Miller & Mosher

[57] ABSTRACT

Process and apparatus are disclosed for the printing of textile bands, such as sponge-cloths with contiguous ends connected to each other by transversal selvedges, on a flat-screen printing machine with an endless carrying belt and printing units, said process consisting:

in arranging between two consecutive sponge-cloths a reference sign to be read by at least one sensor;

in adjusting the advancing of the carrying belt to a repeat equal to the nominal length of the sponge-cloths, and by converting said advance to a number of electrical impulses to be sent to a programmer-computer;

in arranging the printing units at a distance equal to two times said repeat, centering the sponge-cloth manually by conventional means;

in positioning said sensor at a distance from the first printing unit, equal to at least one repeat; and in shifting said printing units proportionally to variations in lengths of each sponge-cloth, with respect to the nominal value, by interlocking said displacements with the programmer-computer, actuated by said sensor which read the actual lengths of each sponge-cloth, said displacements of the various printing units and their actuation to print being automatically controlled and actuated by the programmer-computer, which follows the advance of the sponge-cloth step-by-step so as to obtain, in the case of sponge-cloths longer or shorter than the nominal ones, a corresponding displacement of the printing unit along the machine, and the printing of a sponge-cloth in a centered position.

13 Claims, 11 Drawing Figures

PROCESS AND APPARATUS FOR THE PRINTING OF SPONGE-CLOTHS AND THE LIKE

The present invention relates to a process for the automatic polychrome (multi-color) printing of continuous strips of sponge-cloth with contiguous selvedged ends, of stretch-yarn knitted fabrics, and fabrics with edges and selvedges differently woven, by means of flat-screen printing machines. Within the scope of this invention falls also flat screen printing equipment improved so as to enable said process to be carried out.

As is well known, by the term "sponge-cloth" is generally meant a strip or band (or a plurality of contiguous bands) of sponge-cloths of predetermined nominal length, joined to each other by cross-selvedges (with respect to the weft) and longitudinal selvedges (at the opposite sides according to the warp).

These sponge-cloths, after weaving on looms, do not show constant dimensions. More particularly, such sponge-cloths turn out to be variable so far as the length between them is concerned, both within the field or area of the same piece as well as between the various pieces. Moreover, due to accidental causes during weaving, there may be sponge-cloths considerably shorter than the nominal ones, which are called "faults" and which obviously must not be subjected to a printing process.

The technique at present most in use for the printing of sponge-cloths with multi-color patterns, consists in printing with flat-screen printing machines, single sponge-cloth pieces with pigment dyes, inasmuch as after the printing, the sponge-cloths do not require further finishing steps. In fact, after drying and completion of the polymerization of the pigment, the sponge-cloths are conveyed to packaging.

According to another somewhat less well known technique, the continuous bands of contiguous end sponge-cloths are printed also on flat-screen printing machines, adopting however the expedient (for compensating for variability in length between the sponge-cloths) of tensioning or slackening manually and/or mechanically, by means of an axially adjustable roller, the band of sponge-cloths in order to center from time to time the single sponge-cloth under the printing units (doctors) which are arranged rigidly in fixed position on the side frames of the machine.

By this system one obtains in practice rather poor results so far as quality and precision of the print are concerned, said system being strictly limited by the ability of the personnel that insert the band of sponge-cloths.

Thus the object of the present invention is that of realizing a process suited for allowing, by the use of a flat-screen printing machine conveniently modified and improved, the automatic printing of continuous bands of sponge-cloths with contiguous selvedged ends, which in general are variable in length with respect to each other, with the printing of the desired pattern in the center of the single individual sponge-cloths and with an exact printing repeat between one color and the successive one, equal to that obtainable by conventional flat-screen printing techniques, that is, equal to $\pm 0.1$ mm.

With the process of this invention, that is, with the continuous printing of contiguous-end, uninterrupted sponge-cloth bands, it is possible and convenient to use types of dyes different from pigments, that is, reactive dyes, indanthrene, and the like, for which, unlike the pigments, there are required successive processing steps such as treatment by steam, washing and drying; steps or stages that it would be impossible to carry out if the printing were to be made on single finished pieces.

The foregoing objects of this invention are achieved in practice by an automatic process for the continuous printing of textile bands, preferably bands of sponge-cloths with contiguous ends, joined to each other by cross-selvedges, and of nominal length varying one from one another, on a flat-screen printing machine on an endless conveyor belt advancing in a predetermined intermittent manner, said process consisting or consisting essentially:

in locating or arranging between two consecutive sponge-cloths a reference sign or mark adapted to be read by at least one sensor or the like of a per se known type;

in adjusting the progress of the endless conveyor belt to a value (repeat) equal to the nominal value of the sponge-cloths, and by converting said progress to a predetermined number of electrical impulses to be sent to an electronic computer;

in arranging the printing units (doctors) at a distance equal to two times said progress or repeat value, centering the pattern manually by conventional means;

positioning said sensors at a distance from the first printing unit equal to one or more repeats; and then by carrying out displacements of said printing units proportionally to the variations in length of each sponge-cloth with respect to the nominal value, by interlocking said displacements with the programmer-computer, controlled by said sensors which read the actual lengths of each sponge-cloth, said displacements of the various doctors and their acknowledgment to print being automatically controlled and acknowledged by the programmer-computer himself, which follows the progress of the sponge-cloth step-by-step so as to obtain in the case of sponge-cloths longer or shorter than the nominal sponge-cloth pieces, a corresponding longitudinal displacement of the printing heads along the machine, and the consequential printing of the pattern in a central position within the tolerance limits required and, in the case of sponge-cloth bands progressing diagonally with respect to the printing units, a partial rotation of the printing units themselves, until the pattern-carrying frames are brought into a position perpendicular to the sponge-cloths themselves, in order to achieve the subsequent printing in a central position within said tolerance limits.

More particularly, in the case of the presence of a sponge-cloth much shorter than the nominal ones, said computer-programmer is programmed to operate the displacement of the first doctoring unit to the center of the short sponge-cloth, without acknowledging it to print, and for re-positioning the same doctoring unit on the successive sponge-cloth, with the resumption of the normal printing operation.

The practical embodiment of the automatic printing process cited above is obtained by using an apparatus consisting of a flat-screen multi-color printing machine of the type having preferably the single printing units designed in such a way as to have the printing screens and the corresponding liftable and lowerable doctoring units (for carrying out the printing) operable independently of one another.

Substantially, the improved equipment according to this invention, using said flat-screen printing machine, comprises in combination with one another:

an electrical impulse generating device producing impulses in a quantity proportional to the length of the progress or printing repeat, associated with the conveyor belt of the machine and electrically connected with an electronic computer-programmer provided for the control and acknowledgment in a sequential way of the single printing unit;

a device for reading and determining the differences in length of the sponge-cloths advancing on the conveyor belt, consisting of at least one electromechanical, photoelectrical sensor or the like, mounted adjustably lengthwise and in the sense of the width of the printing plane, and that is arranged such as to acknowledge said programmer to carry out both the displacements of the printing units in a centered position on the sponge-cloths as well as the printing operation on said sponge-cloths;

a control device for the longitudinal motion along the printing plane, and the partial rotation with respect to the same, of the printing units consisting of: an interposed rack on the two side frames, between the usual sliding guides and the carriages of the single printing units, with which rack meshes a toothed pinion driven by a step-by-step motor associated with the two ends of each printing unit and controlled by said computer-programmer so as to allow carrying out the correction requests of the position of the printing units themselves, manually operated control means, such as lever switches or the like, provided on both sides of each printing unit for the initial positioning of said units, with the programmer excluded; and a hinge device, one at each opposite head of the printing units, substantially consisting of spherical or semispherical joints adapted to allow each printing unit to turn about itself for carrying out the correction of the obliquity between the axis of the advancing sponge-cloths and the longitudinal axis of the printing plane.

This invention will now be described in still greater detail, according to a preferred practical embodiment, with reference to the figures of the attached drawings which are given for purely indicative and not limiting purposes, wherein:

FIGS. 7, 8 and 9 show schematically three further views which are, respectively, a front, a side, and a plan view of a printing (doctoring) unit of the present invention; while

As already explained, the printing process of this invention uses a flat-screen printing machine so improved as to obtain programmed displacements of the printing units to ensure in all circumstances a printing of the predetermined multicolor patterns always in the center of the sponge-cloths (which often are of a different length in respect of the nominal one).

Figure 1:
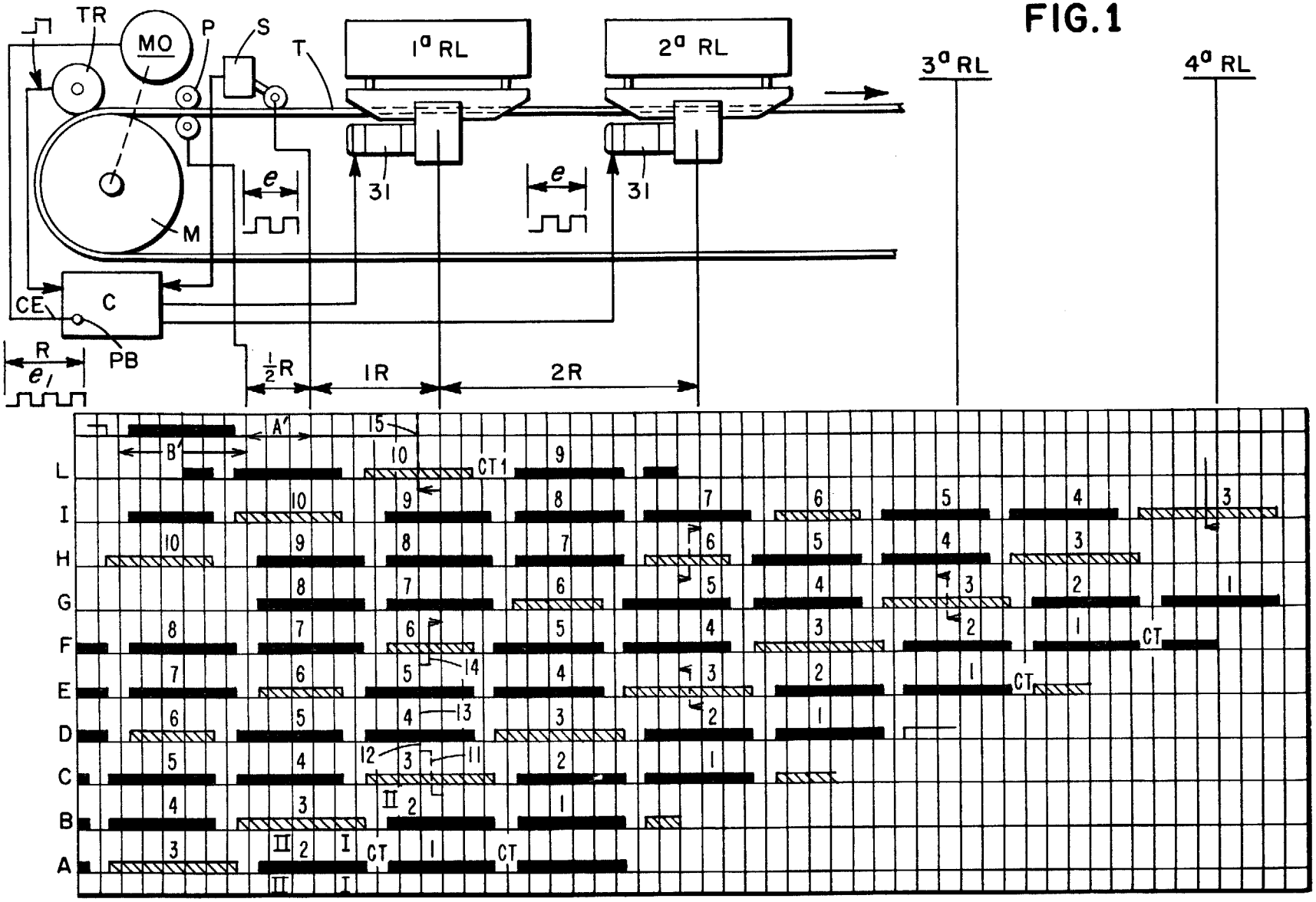
FIG. 1 represents a diagram of the sequence of the operational stages for the printing of a continuous band of sponge-cloths or the like, some of them having a theoretical or predetermined length and others having lengths differing from the theoretical, which operational stages are carried out according the the process and with the equipment of this invention.

For a better understanding of the process, FIG. 1 shows schematically the positions which a continuous sponge-cloth band assumes successively under the various printing units, and the consequential displacements of the printing units themselves in order to obtain a printing always centered with respect to a single sponge-cloth.

More particularly, FIG. 1 shows (schematically represented) a flat-screen printing machine M on whose rubberized conveyor belt T are arranged 4 printing units or doctoring units indicated as $1^a$RL, $2^a$RL, $3^a$RL and $4^a$RL, as well as a reading sensor S and a transducer TR, connected to a computer-programmer (not represented in the drawing). The structural and functional characteristics of these devices will be described in detail further on.

FIG. 1 also indicates a continuous band of sponge-cloths with contiguous selvedged ends marked with numbers from 1 to 10. Each sponge-cloth is connected to the preceding one and to the subsequent one by a cross-selvedge CT (see FIG. 2) so as to form a continuous ribbon or band to be glued, for the printing, on conveyor belt T of the machine, according to conventional technique.

In the case illustrated in FIG. 1, the conveyor belt contains or supports the sponge-cloths of nominal length, of greater and shorter length, as well as for instance a selvedge $CT_1$ of a length greater than the others. More particularly, in this figure the sponge-cloths indicated by the numbers 1-2-4-5-7-8-9, are all of the nominal length and, in the diagram, equal to six squares, selvedges included; sponge-cloth 3 has a length greater than the nominal length (7 squares); sponge-cloth 6 is shorter than nominal length; while sponge-cloth 10, of nominal length, is however connected to sponge-cloth 9 by selvedge CT which is greater in length than that which connects all the other sponge-cloths, the latter in the drawing being shown as equal to one square.

In the same FIG. 1, the band of sponge-cloths 1–10 is represented in different positions (with respect to the first doctor (1R in the drawing)) marked by the letters from A to L. In position A the band presents sponge-cloth 1 under the doctor $1^a$RL in a centered position. In position B the band has advanced (towards the right) by one printing repeat or interval wherefore sponge-cloth 2 comes to be under the first doctor $1^a$RL. In position C sponge-cloth 1 comes to be under doctor $2^a$RL while sponge-cloth 3 shifts under the first doctor $1^a$RL, etc.

With the progressing of the conveyor belt the sponge-cloths come to be under the various doctors as indicated schematically in FIG. 1 from bottom to top, i.e., from A to L, and the printing of the various sponge-cloths, even if they are of lengths different from nominal length, and also in case they are diagonally positioned with respect to the doctors, will occur always in the center of the sponge-cloths themselves thanks to well-defined displacements of the doctors, programmed and carried out according to a sequence of operational stages which form an important part of this invention.

This sequence of operational stages may be realized in combination with a particular arrangement of the components of the flat-screen printing machine, and more particularly in the following way, which is given for purely illustrative and not limiting purposes:

Before starting the continuous printing of the sponge-cloths, the printing machine is started idling, that is, with no sponge-cloths on the carrying belt T. In this way the transducer TR (FIG. 1), in contact with carrying belt T, sends to the programmer-computer C a number of impulses "e'" equal to the advance (repeat) R of the carrying belt. This number of impulses e' forms a "basic number of impulses" which is used by the computer itself as a comparative term on which the computer will carry out sums and subtractions with reference to the number of impulses which will be detected by the same transducer TR, in correspondence with the length of the single sponge-cloths advancing on the carrying belt.

The computer, thereupon, will work out the error "e" (FIG. 1) ("e" being the difference between the impulses corresponding to one sponge-cloth and the basic number of stored impulses) and will then halve this error sending half the number of impulses, in successive times, to each single step-by-step motor 31 connected with the printing units RL.

Said repeat R is established at the starting of the machine, and is equal to the mean value of the lengths of the various sponge-cloths to be printed (for instance, the mean length of 10 sponge-cloths).

This is done in order to have, during the printing stage, the possibility of shifting (displacing) the printing units either to the right or to the left on the basis of the positive or negative errors worked out by the computer in relationship with the different lengths of the sponge-cloths.

In order to start the printing machine, on the computer there is provided a push button PB (FIG. 1) which, when pressed manually, will close an electric power circuit CE which will start off the electric hydraulic motor MO driving the carrying belt; in this way the machine will carry out a full printing cycle by manual control.

After completing one printing cycle by manual control, in order to set the machine, a second push-button, placed on the computer is pressed down, this push-button keeping said electric circuit CE constantly closed, thus allowing the computer to automatically carry out the successive printing operations (i.e.: advancement and return of the carrying belt with the sponge-cloths), also sending the error-signals worked out to the step-by-step motors.

Substantially, during the automatic operation the computer uses the impulses corresponding to the lengths of the sponge-cloths and, after a comparison with the basic number of impulses corresponding to one repeat R of the carrying belt, sends the error impulses as already explained above, to the single printing units.

In FIG. 1 are shown four printing units in as much as it has been supposed to print sponge-cloths in four different colors.

The intermittent advance R of the conveyor belt T (FIG. 1) is adjusted to a value equal to the nominal length of the sponge-cloths. In the case of the sponge-cloths of FIG. 1, advance R is assumed to be equal to 6 squares of the graph paper, which facilitates the visualization of the various sponge-cloth lengths and the understanding of the successive operational stages. Thereupon, the printing units (that is, doctors $1^a$RL, $2^a$RL, $3^a$RL, $4^a$RL) are arranged on the printing table at a distance from each other two times said advance. Then, after the mounting of the pattern-carrying frames, these latter are adjusted "to pattern" (that is, they are centered with respect to the printing units) by the conventional system.

Thereupon a sensor S, or even two sensors for reasons that will be explained further on, is put into position at a distance for instance from the first doctor equal to the advance or repeat R, and then the position of the sensors are adjusted with respect to the sponge-cloths that have to be controlled.

Figure 2:
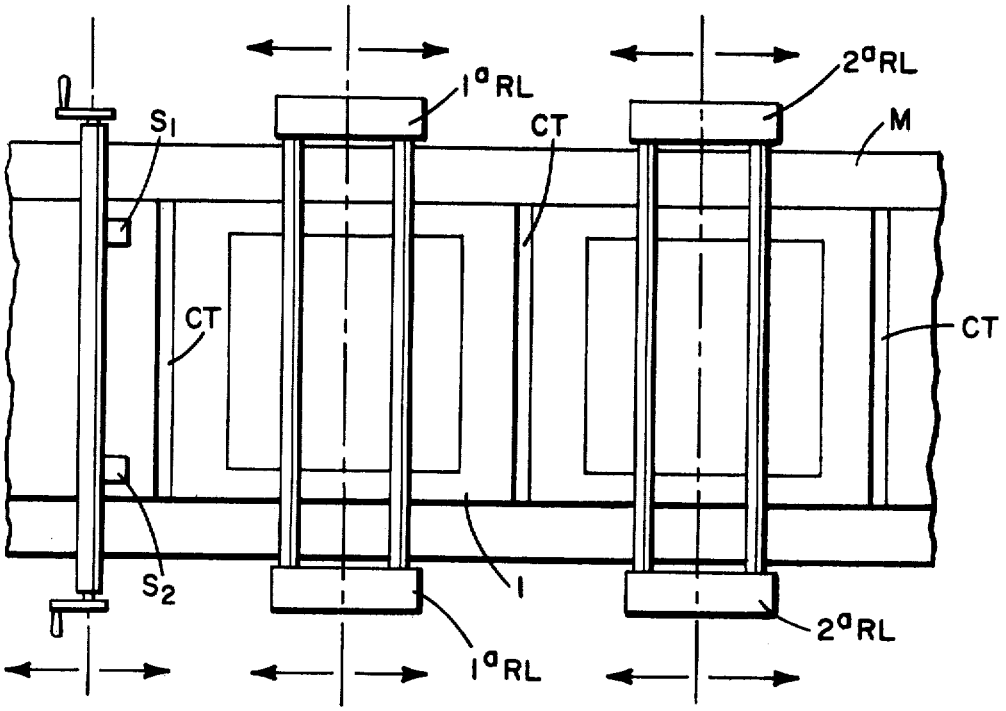
FIGS. 2 and 3 show schematically a flat-screen printing table on which a sponge-cloth band or the like has been glued, which band in FIG. 2 is positioned with its longitudinal axis perpendicular to the printing screens, while in FIG. 3 it is positioned diagonally with respect to the printing screens.

There is then introduced into the machine the sponge-cloth band (indicated as a succession of sponge-cloths from 1 to 10, spaced apart by cross-selvedges CT) and as the ideal reference line may be assumed the line indicated by P in FIG. 1. This reference line is fixed at a distance from sensor S equal to half a repeat (R/2), indicated by A' in FIG. 1. Thereupon conveyor belt T is made to advance by two or three repeats or intervals so that the operator may verify whether the introduction of the sponge-cloth is correct, that is, with its own longitudinal axis progressing, for instance, perpendicularly to the axes of the doctor units, as indicated in FIG. 2. For this control stage, each advancement of the conveyor belt T is acknowledged by acting on a pushbutton provided on the programmer.

At this point, the equipment is ready to start with the data and automatic printing memorizing stages according to the operational sequence hereunder described and, for the time being, limited to the utilization of sponge-cloths of different lengths, and introduced perpendicularly to the doctoring units (see FIG. 2). For bands introduced diagonally (as in FIG. 3), the corresponding printing process will be described further on.

Figure 6:
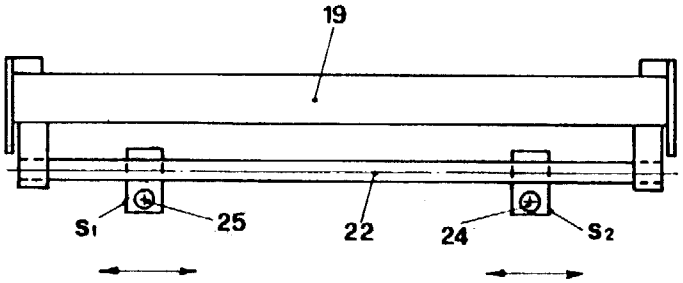
Figure 8:
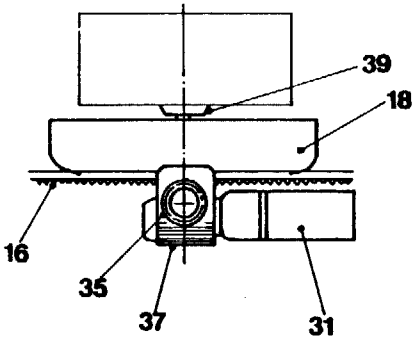
Figure 7:
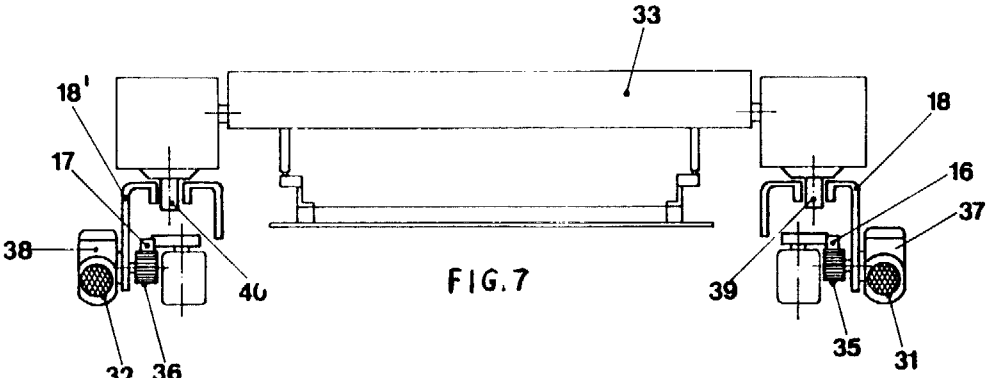
Figure 9:
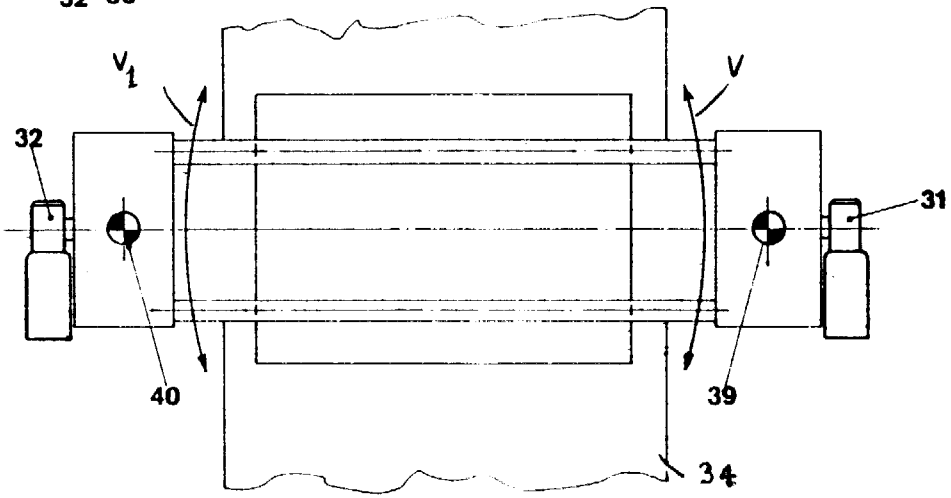
Figure 10:
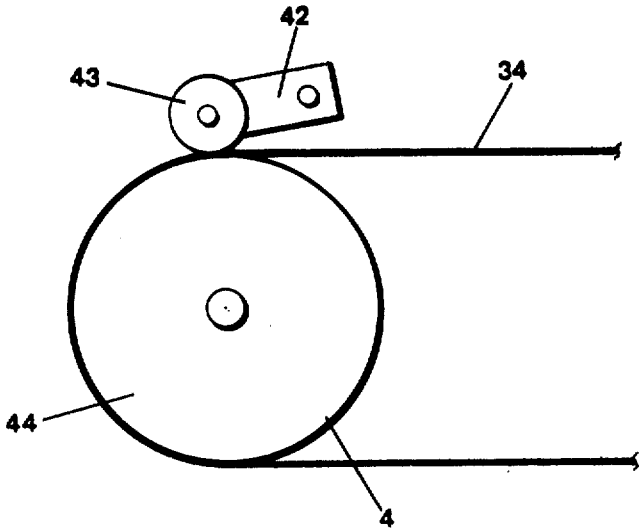
FIGS. 10 and 11 show, respectively, a side and a plan view of an electrical impulse-generating device, applied to a roller or transmission cylinder of a flat-screen printing machine, according to this invention.
Figure 11:
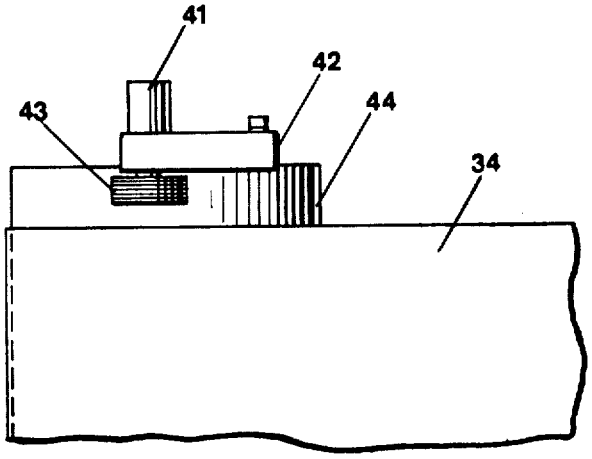

Let us now assume that in the center-line of each selvedge there was introduced a reference element or sign that can be read electronically by sensor S. In the cited case of sponge-cloths advancing in a straight line, as in FIG. 2, the principle on which the process is based is the following:

Let it be assumed that the machine is operating and that a sponge-cloth B' (FIG. 1) is taken into consideration, its length being equal to the nominal length, that is, to one repeat and corresponding, in FIG. 1, to 6 squares, selvedges included. At the start of the advance of the sponge-cloth in zone A', the impulse-generator begins to send to the programmer a number of impulses proportional to A' (equal to R/2). When the sponge-cloth B' starts passing under sensor S, this latter is activated and sends to the programmer a signal for starting the counting of the number of impulses, a counting that will be stopped by the same sensor S when the sponge-cloth B', having advanced by another ½R, will be stopped because it will then have advanced a complete advance, equal to R. During the displacement of one full advance, the programmer will have stored a quantity of impulses equal to the displacement R and another equal quantity of impulses counted by control of the sensor S and corresponding to the whole length of the sponge-cloth read.

The quantity of impulses equal or corresponding to R and the quantity counted, equal to B', are then compared by the programmer and, since in this case the difference between the impulses corresponding to B' and those corresponding to R is zero (R−B'=O), there is no correction to be applied to the first doctor unit. The programmer in fact, in all cases in which the sponge-cloth presents itself under the sensor in a nominal length (6 squares in FIG. 1) will not detect any error and, thus, will not impart any further correction of displacement of the first doctor unit to allow the printing of the pattern in the center of the sponge-cloth.

However, in the case in which the advancing sponge-cloth is longer or shorter (for instance by one square) than the nominal length, the programmer will carry out the sum of the calculations stored in the computer in correspondence with readings made on the first part and on the remaining part of the sponge-cloth itself (which are not equal to each other with respect to sensor S), will carry out the comparison between the number of impulses equal to a repeat (6 squares) and said sum of impulse corresponding to the actual length of the sponge-cloth, it will then draw from it the error and will halve it, and the impulse equal to this "half error" will then be sent, in the form of a control signal, to the step-by-step motors of the first doctor unit which will be shifted by such a quantity as to allow the printing to be made in the center of the sponge-cloth. This signal is also stored by the programmer and subsequently sent in sequences to the other doctor units, which consequently displace themselves like the first one, and will therefore print the other colors in the center of the same sponge-cloth.

Now that the principle of the reading and comparing of data relating to a sponge-cloth B' of a certain nominal length has been made clear, in the following there will be illustrated the complete sequence of the operational stages of the printing of a continuous band of sponge-cloths, some of which have the nominal length while others have different lengths.

FIG. 1, as already said, represents a band with 10 sponge-cloths in different positions from A to L, corresponding to advances between one position and the next that are equal to each other.

Supposing the machine to be operating, that is, with sponge-cloth 1 having a nominal length equal to 6 squares, in a centered position under the first doctor unit (position A), the next sponge-cloth 2 will find itself centrally positioned under sensor S. This will mean that, while sponge-cloth 1 was shifting a distance ½R, the sensor will have read, and the programmer will have computed and stored a quantity of impulses corresponding to the length of the first part (Part I) of the sponge-cloth 2. At the end of the subsequent similar advance, the sensor S will have read the second part (Part II) of the sponge-cloth 2 and the programmer will have stored the corresponding quantity of impulses.

At this point the programmer carries out the comparison between the impulses equal to one advance, and the sum of the impulses of these two readings. Since the squares read in correspondence with the two readings are respectively 3 (Part I) and 3 (Part II), the sum will be equal to 6. The repeat, too, is equal to 6 squares. The difference is therefore zero.

Thus, since the difference between said two quantities is zero, the programmer does not acknowledge or activate the shifting of first doctor unit, but acknowledges or activates the printing only, at the moment sponge-cloth 2 reaches the central position under the first doctor unit (position B).

During a further advance equal to 6 squares, sponge-cloth 2 is followed by sponge-cloth 3 (longer and equal to 7 squares) of which sensor S reads at first Part I and successively Part II. In correspondence with Part I, the programmer will store impulses equal to three squares, while for Part II it will store impulses equal to 4 squares. From the comparison between the number of impulses equal to a repeat R (6 squares) and the sum of said two readings (equal to 7 squares), the programmer calculates the difference that turns out to be equal to minus one square. The error or difference being thus equal to one square, the correction imparted to the first doctor unit is of half a square less, sending the correction of the second half square back to the successive advance or repeat. The doctor unit is thus shifted to the left by half a square (line 11 of position C) wherefore the printing is effected in the center of the sponge-cloth (position C).

Continuing to advance, the carrying band moves sponge-cloth 4, of nominal length equal to 6 squares, forward and, after a reading as previously indicated, the programmer compares the advance R(6 squares) with the sum of reading of Part I (equal to 2 squares) and the reading of Part II (equal to 4 squares). From the comparison (6−6=0 squares) the error determined is equal to zero. Nevertheless, the first doctor unit, having already completed its shifting by half a square which equals half an error stored previously, is shifted further to the left by another half a square for a total of one square, thus printing sponge-cloth 4 in its center (line 12, position D).

Going on, for sponge-cloth 5, of nominal length, the error resulting from the comparison between the sum of the readings of Part I and of the readings of Part II thereof, corresponds to zero squares, wherefore the correction equal zero. Doctor unit $1^a$RL being already displaced to the left by one square, can now print (line 13) in the center of sponge-cloth 5 without any further displacement (position E).

For the following sponge-cloth 6, shorter by one square, the sum of the readings of Part I and those of Part II thereof is equal to five squares. The difference between the impulses corresponding to one repeat (6 squares) and said sum is equal to one square more. The error of one square thus gives rise to a correction of half a square wherefore the first doctor unit $1^a$RL will be acknowledged or activated to shift from the preceding printing line by half a square to the right, and then print in the center of sponge-cloth 6 along line 14 (position F). The remaining correction of the other half square will be effected at the successive advance.

For the following sponge-cloths 7, 8 and 9, of nominal length (6 squares) the first doctor unit will not shift from the preceding line (positions G-H-I), the error being zero calculated according to what was indicated for the other sponge-cloths. However, for sponge-cloth 10, connected to sponge-cloth 9 by cross-selvedge $CT_1$ which is longer by one square with respect to the cross-selvedges CT of the other sponge-cloths, the correction occurs in one single stage equal to the whole calculated error and hence, because of the fact that only the selvedge $CT_1$ is greater by one square, the sensor detects only the greater length of the same.

The correction will thus be of minus one square and the first doctor unit $1^a$RL will be shifted to the left by one square, and therefore printing in the center of sponge-cloth 10, according to line 15 (position L).

The errors and corresponding corrections are worked out by the programmer and are then memorized so as to acknowledge or activate also the successive doctor units ($2^a$RL, etc.) according to a control that is a sequential control and that follows step-by-step the progress of the sponge-cloths.

If during the printing operation there should be found a faulty sponge-cloth very much shorter than nominal length, the programmer will shift the first doctor unit onto the center line of this sponge-cloth without however acknowledging or activating it for printing, inasmuch as if that were to be done, two contiguous sponge-cloths would be spoiled.

At the next advance, in the case of a normal sponge-cloth, the first doctor unit is repositioned on the center line of said sponge-cloth and is acknowledged or activated for printing.

If for a successive series of shift increments, the doctor units shift by one length greater than the nominal value of a sponge-cloth, the programmer is prepared to bring the doctor units back automatically to the starting position, thus carrying out properly the printing on the sponge-cloth of the successive advance of the carrying belt.

From the foregoing, it is clearly shown that sensor S detects the difference in length between the sponge-cloths and acknowledges or activates the printing of said sponge-cloths provided that the introduction into the machine of the sponge-cloths is perpendicular to the printing frames.

Figure 3:
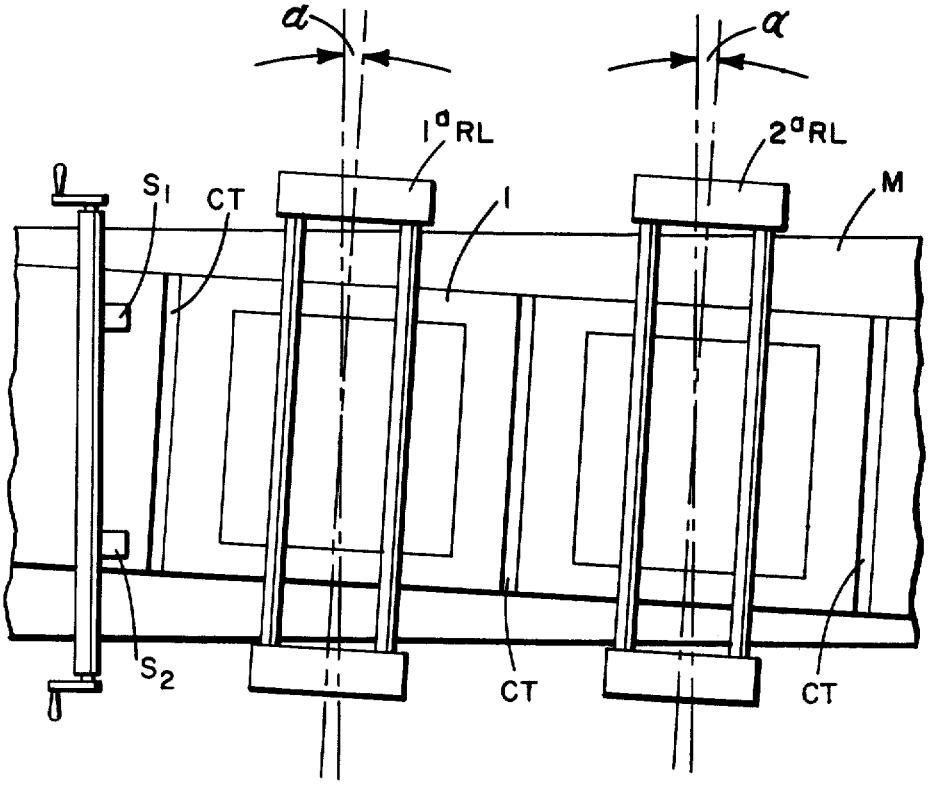
Figure 5:
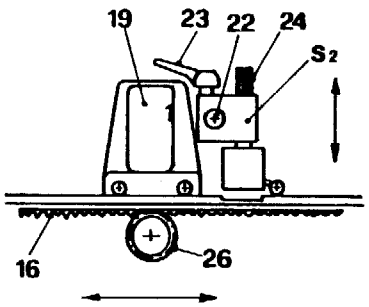
FIGS. 4, 5 and 6 show schematically three views which are, respectively, a front view, a lateral view, and a plan view of a sensing device or the like for reading the sponge-cloth lengths.
Figure 4:
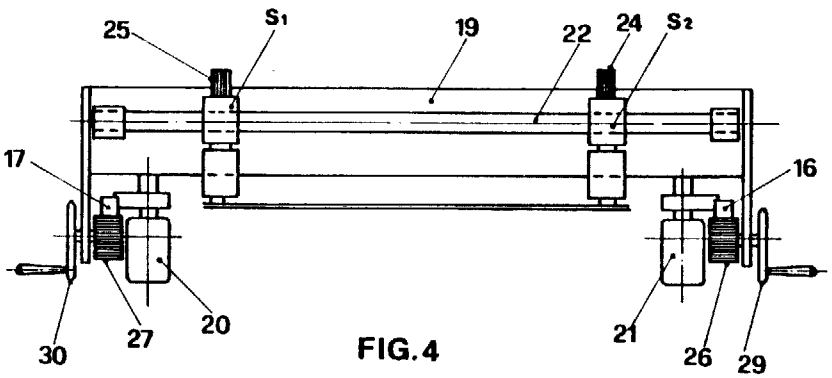

In case the introduction of the sponge-cloths should occur in a position diagonally directed with respect to the printing frames as indicated in FIG. 3, then in order to be able to print in the center of the sponge-cloths it is necessary to rotate the doctor units (FIG. 3) in order to bring them back into a position perpendicular to the longitudinal axis of the individual sponge-cloths. In this case, two sensors $S_1$ and $S_2$ are provided which are connected respectively to two programmer-computers which are capable of detecting the different positions (that is in different times) of the edges (or reference sign introduced at mid-selvedges CT) of each sponge-cloth. Practically, that is, the sensor reading and detecting first the beginning of the edge of the sponge-cloth advancing diagonally, through its program acknowledges or activates the first doctor unit ($1^a$RL) to rotate about its hinge-point (which will be described in detail further on) arranged on the side opposite the side of correction, so as to put the printing frame in a position perpendicular to the sponge-cloths.

For the practical realization of the process illustrated above with the aid of the attached FIGS. 1 to 3, there is used an equipment which, as already said, consists of a conventional flat-screen printing machine improved according to the present invention. The improvements consist in a series of electromechanical and electronic devices which are described hereinafter with the aid of FIGS. 4 to 11.

One of these devices consists of two racks 16 and 17 (FIGS. 4–5 and 7–8) arranged on each side of the printing machine and in a position flanking the usual slide guides for carriages 18, on which are mounted the ends of the printing units.

Another part of the device consists of a sensor-carrying saddle consisting of a beam 19 (FIGS. 4 to 6) displaceable along the printing plane on supports sliding along the side frames 20 and 21 and supporting an overhanging, splined shaft 22 on which are mounted sensors $S_1$ and $S_2$ (which may be of the electromechanical, optical, electronic, infrared, radioactive isotopes, photochemical type or of other similar types), each adjustable along the length of the shaft 22 by means of a manually operated lever-locking system 23. The sensors are also adjustable in height (with respect to the printing plane) through moving their threaded supports maneuverable by means of small handwheels 24 and 25. The carriage carrying the sensor-supporting beam is, moreover, traversable along the printing plane by means of two toothed wheels 26 and 27 which mesh with said racks 16 and 17, and maneuverable by means of terminal hand wheels 29 and 30.

The improved printing units (FIGS. 7 to 9) according to this invention maintain the devices for the manual adjustments both longitudinally as well as transversely, common to the conventional printing units. The improvements consist in applying to each end of the carriages 18 and 18' and electric step-by-step motor, 31 and 32, for the bilateral drive of the motions of the doctor units 33, with respect to carrying belt 34 (FIG. 9), and such as to allow with very considerable precision, on the impulse of a signal coming from said electronic computer-programmers (not represented in the drawings), the self-positioning of the doctor unit according to pre-fixed values as described above.

Each step-by-step motor, in fact, may, through reduction gear 37–38 and toothed wheel 35–36 in mesh with said rack 16–17, shift the printing frame-carrying carriages longitudinally with respect to the printing plane, in one direction or the opposite on the urge of electrical impulses coming from the cited computers, and equal to the corrections which the printing unit must carry out in order to be able to print in the center of the sponge-cloths. The doctor units, as thus modified, may be positioned along the machine, before starting to print or for successive corrections (with the programmer excluded) by means of conventional lever-switches.

Moreover, in order to allow each doctor unit to rotate about itself in order to position itself perpendicularly to diagonally advancing sponge-cloths, as in FIG. 3, the opposite heads of each doctor unit are mounted on hinges on the corresponding carriage. Hinges 39–40 of the semi-spherical type or the like, allow the doctor unit to rotate either pivoting to the right or to the left, depending on whether the correction imparted by the programmer (in the case of the diagonal advance of the sponge-cloths) is requested either on the left or on the right side of the machine.

In order to allow appreciable rotation angles, at least one of said hinges is so arranged as to allow the articulated joint or journal to shift perpendicularly to the machine. In this way the doctor unit pivoting about one of its ends may shift its opposite end according to an arc of a circle $V-V_1$ (FIG. 9) which would be impossible if both hinges were only rotation hinges.

Finally, the apparatus is completed by an electrical impulse-generating device (FIGS. 10–11) of a known type, consisting of an electronic digital transducer 41, supported by an arm 42 and driven by a tracer-wheel 43 in contact with the driven (or transmission) roller or cylinder 44 on which is stretched the carrying belt 34. Said transducer is a generator of a series of impulses, having a frequency proportional to the speed of advancement of the carrying belt and, in this specific case, sends to the programmer a number of impulses in a quantity proportional to the length of the repeat of the printing.

With the above-indicated improvements, a flat-screen printing machine can realize the process described above with a printing precision, in the case of continuous bands of sponge-cloths with contiguous ends or other fabrics of similar behavior, that is at least equal to that of the conventional multi-color printing machines.

What is claimed is:

1. Apparatus for effecting an automatic multi-color printing process for sponge-cloths with contiguous ends or continuous textile bands of stretch-yarn fabrics and the like, characterized in that there is provided a conventional flat-screen printing machine comprising:

an electrical impulse generating device produced impulses in a quantity proportional to the length of the print repeat, synchronized with the carrying belt of the machine and electrically connected to an electronic computer-programmer for controlling and actuating in a sequential way the individual printing unit;

a device for reading and detecting the differences in length of the sponge-cloths advancing on the carrying belt, comprising at least one electromechanical, photoelectrical sensor, mounted adjustably lengthwise and with respect to the width of the printing plane, and arranged to actuate said programmer to effect the shiftings of the printing units in a position centered on the sponge-cloths, and effect the printing operation on said sponge-cloths;

a control device for effecting traverse motion of the printing unit along the printing plane and partial rotation with respect to the printing plane, comprising:

a carriage for each printing unit, said carriage being held by two guide slides, two racks connected to each side of said carriage, each of said racks engaged with first and second pinions;

first and second stepping motors for driving each of said pinions in response to a pulse applied to each motor;

means connecting said stepping motors to said computer-programmer, whereby the position of said printing units with respect to said printing plane is controlled by said computer-programmer;

mechanical adjustment means provided on each side of said printing unit for initially positioning said printing unit; and means for rotating said printing units with respect to said printing plane comprising a partially spherical hinge located on each side of said carriage, connected to said printing unit permitting pivoting of said pivot unit with respect to said carriage.

2. Apparatus for effecting an automatic multi-color printing process for sponge-cloths with contiguous ends or continuous textile bands of stretch-yarn fabrics and the like, characterized in that there is provided a conventional flat-screen printing machine comprising:

an electrical impulse generating device producing impulses in a quantity proportional to the length of the print repeat, synchronized with the carrying belt of the machine and electrically connected to an electronic computer-programmer for controlling and actuating in a sequential way the individual printing unit;

a device for reading and detecting the differences in length of the sponge-cloths advancing on the carrying belt, comprising at least one electromechanical, photoelectrical sensor, mounted adjustably lengthwise and with respect to the width of the printing plane, and arranged to actuate said programmer to effect the shiftings of the printing units in a position centered on the sponge-cloths, and effect the printing operation on said sponge-cloths;

a control device for effecting traverse motion along the printing plane and partial rotation with respect to said printing plane of the printing units, comprising a rack interposed on two side frames between the usual guide slides and the carriage of the individual printing units, with which rack is engaged a toothed pinion driven by a step-by-step motor coupled to the two ends of each printing unit and controlled by said computer-programmer so as to carry out the position-correction requests for the printing units themselves, manually operated control means provided on both sides of each printing unit for the initial positioning of said units, with the programmer excluded; and a hinge device, one at each opposite head of the printing units, substantially consisting of spherical or semi-spherical joints adapted for allowing each printing unit to turn about itself for carrying out the correction for the angle between the axis of the advancing sponge-cloths and the longitudinal axis of the printing plane.

3. Apparatus according to claim 2, characterized in that said impulse-generator consists of an electronic transducer emitting a quantity of impulses proportional to the advance of the carrying belt, and actuated by a scanning wheel which contacts the driven cylinder of the carrying belt and is electronically connected with said computer-programmer.

4. Apparatus according to claims 2 or 3, characterized in that said sensors are mounted adjustably on a supporting beam anchored to carriages adapted for movement across the printing plane by means of toothed wheels meshing with said racks arranged along the side frames of the machine, said sensor-carrying beams being operated by handwheels acting on said toothed wheels.

5. Apparatus according to claims 2 or 3, characterized in that said sensors are of the electromechanical, photoelectrical, infrared, radioactive isotopes, or photochemical type, and are adapted to read both the reference signs or marks on the selvedges as well as the end of the edges of the sponge-cloths advancing on the carrying belt.

6. Apparatus according to claims 2 or 3, characterized in that at least one of said hinges, arranged to form pivoting means for the rotation of the ends of the various printing units, is provided with its own articulated joint, partially displaceable with respect to the axis of the doctor unit itself, adapted to displace its opposite end along the arcs of a circle pivoting around a hinge as its center.

7. A process for the automatic continuous printing of sponge-cloths with contiguous ends connected to each other by transversal selvedges, said sponge-cloths having a nominal length varying from each other, on a flat-screen printing machine with an endless carrying belt which advances with a predetermined intermittent motion and is provided with at least one printing unit, said process being characterized in that it comprises:

arranging between two consecutive sponge-cloths a reference sign adapted to be read by at least one sensor;

manually adjusting the advancing of the carrying belt to a repeat equal to the nominal length of the sponge-cloths, and converting said advance to a predetermined number of electrical impulses to be sent to a programmer-computer;

arranging the printing units at a distance equal to two times said repeat and centering the sponge-cloth with respect to said printing units;

positioning said sensor at a distance from a first printing unit, equal to at least one repeat; and shifting said printing units longitudinally proportional to the variations in lengths of each sponge-cloth, with respect to the nominal value, in response to a signal provided by the programmer-computer, actuated by said sensors, which reads the actual lengths of each sponge-cloth, and calculates the difference between said nominal value and the actual value of a sponge-cloth to be printed, whereby said printing units and their actuation is automatically controlled and actuated by the programmer-computer, which follows the advance of the sponge-cloth step-by-step so as to obtain, in the case of sponge-cloths having a length different than the nominal length a corresponding longitudinal displacement of the first printing unit along the machine, whereby the sponge-cloth is printed in a centered position within a required tolerance limit.

8. A process according to claim 7, wherein the displacements of the printing units, proportional to the differences in length of the sponge-cloths, are obtained by a number of electric impulses emitted by said computer-programmer, these impulses corresponding to the correction to be feed to step-by-step motors actuating directly the printing units, said correction being based on the error calculated by the computer by comparison, at each repeat advance of the carrying belt, between the number of impulses corresponding to said advance and stored in a memory of said computer, and the sum of impulses corresponding to the length of each sponge-cloth, said impulses being counted by said sensor which reads the total length of each sponge-cloth during two successive advances of the carrying belt.

9. A process according to claim 7, characterized in that the possible errors, resulting from the comparison between the impulses corresponding to one repeat and the impulses corresponding to the length of the sponge-cloth, are halved by said computer, one half being sent, in the form of an operating signal, to the step-by-step motor of the first printing unit, to ensure the printing in the center of the sponge-cloth just read, the other half being stored by the computer itself and sent to each of the successive printing units upon the successive advance of the carrying belt, in order to obtain the desired displacement of the remaining printing units equal to the total error detected.

10. The process according to claim 1, further comprising rotating the printing units to position the printing units in a perpendicular relationship to the sponge-cloths.

11. A process according to claim 8, characterized in that the possible errors, resulting from the comparison between the impulses corresponding to one repeat and the impulses corresponding to the length of the sponge-cloth, are halved by said computer, one half being sent, in the form of an operating signal, to the step-by-step motor of the first printing unit, to ensure the printing in the center of the sponge-cloth just read, the other half being stored by the computer itself and sent to each of the successive printing units upon the successive advance of the carrying belt, in order to obtain the desired displacement of the remaining printing units equal to the total error detected.

12. A process according to claim 10, wherein two reading sensors are provided in the case of sponge-cloths introduced diagonally into said printing units, each of said reading sensors being connected to its own separate computer, the first of said sensors reading and detecting the beginning of the sponge-cloth edge, or a reference sign in the mid-point or center of the selvedge, advancing diagonally, thereby actuating by its own individual computer the first printer unit to turn about a hinge-point opposite the one to be corrected, until the printing frame is positioned perpendicularly to the sponge-cloths.

13. A process according to claim 7, 9 or 1 wherein errors representing the difference between said nominal value and actual value and corresponding corrections, derived by said programmer-computer, are memorized for actuating successive printer units sequentially, in the case of multi-color printing, following step-by-step the advance of the sponge-cloths through the printing machine.

* * * * *